US008789702B1

(12) United States Patent
Shingyouchi-Hall

(10) Patent No.: US 8,789,702 B1
(45) Date of Patent: Jul. 29, 2014

(54) COLLAPSIBLE TOILETRY CONTAINER ASSEMBLY

(71) Applicant: Chiaki Shingyouchi-Hall, Sherman Oaks, CA (US)

(72) Inventor: Chiaki Shingyouchi-Hall, Sherman Oaks, CA (US)

( * ) Notice: Subject to any disclaimer, the term of this patent is extended or adjusted under 35 U.S.C. 154(b) by 10 days.

(21) Appl. No.: 13/670,877

(22) Filed: Nov. 7, 2012

(51) Int. Cl.
*B65D 71/00* (2006.01)
*A45D 40/00* (2006.01)
*A45C 3/00* (2006.01)

(52) U.S. Cl.
USPC ..... 206/581; 132/314

(58) Field of Classification Search
CPC ..... A45C 3/00; A45C 5/005; A45C 11/08; A45D 40/00
USPC ..... 206/577, 570–572, 581; 150/112–117; 132/314; 220/767–769; 222/92, 106
See application file for complete search history.

(56) References Cited

U.S. PATENT DOCUMENTS

| | | | | |
|---|---|---|---|---|
| 4,880,315 | A | 11/1989 | Berry et al. | |
| 5,791,481 | A * | 8/1998 | Thomas | 206/581 |
| 6,959,806 | B2 | 11/2005 | Barker | |
| 7,040,486 | B2 * | 5/2006 | Godshaw et al. | 206/581 |
| 7,854,317 | B1 * | 12/2010 | Hebert et al. | 132/314 |
| D640,055 | S | 6/2011 | Mailet | |
| D646,485 | S | 10/2011 | Mason | |
| 2001/0040172 | A1 | 11/2001 | Pirrallo | |
| 2004/0118477 | A1 * | 6/2004 | Desmond | 141/18 |
| 2006/0108251 | A1 * | 5/2006 | Sherrer et al. | 206/581 |
| 2008/0105328 | A1 * | 5/2008 | Desmond | 206/581 |
| 2009/0127045 | A1 | 5/2009 | Williams et al. | |
| 2009/0230000 | A1 | 9/2009 | Sackos | |

* cited by examiner

*Primary Examiner* — Bryon Gehman

(57) ABSTRACT

A collapsible toiletry container assembly transports toiletries in a compact and organized manner. The assembly includes a container having a bottom panel and a flexible perimeter wall defining an interior space. A divider defines a plurality of compartments in a bottom of the interior space. A top portion of the perimeter wall extends upwardly from the divider. Each of a plurality of pouches is positionable in a selectable one of the compartments in the interior space. The top portion of the perimeter wall is foldable into an overlapping closed position over the pouches. Each of a plurality of caps is couplable to a selectable one of the pouches wherein an opening in the pouch is closed. A clip is couplable to the top portion of the perimeter wall when the top portion is in the closed position wherein the clip holds the top portion in the closed position.

10 Claims, 5 Drawing Sheets

COLLAPSIBLE TOILETRY CONTAINER ASSEMBLY

BACKGROUND OF THE DISCLOSURE

1. Field of the Disclosure

The disclosure relates to toiletry transport devices and more particularly pertains to a new toiletry transport device for storing and transporting toiletries in a compact and organized manner.

2. Summary of the Disclosure

An embodiment of the disclosure meets the needs presented above by generally comprising a container having a bottom panel and a flexible perimeter wall extending upwardly from a perimeter edge of the bottom panel defining an interior space. A divider is positioned in the interior space. The divider defines a plurality of compartments in a bottom of the interior space. A top portion of the perimeter wall extends upwardly from the divider. A plurality of pouches is provided wherein each pouch is positionable in a selectable one of the compartments in the interior space. The top portion of the perimeter wall is foldable into an overlapping closed position over the pouches when the pouches are positioned in the interior space. Each pouch has an opening. A plurality of caps is provided. Each cap is couplable to a selectable one of the pouches wherein the opening in the pouch is closed. A clip is provided. The clip is couplable to the top portion of the perimeter wall when the top portion is in the closed position wherein the clip holds the top portion in the closed position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
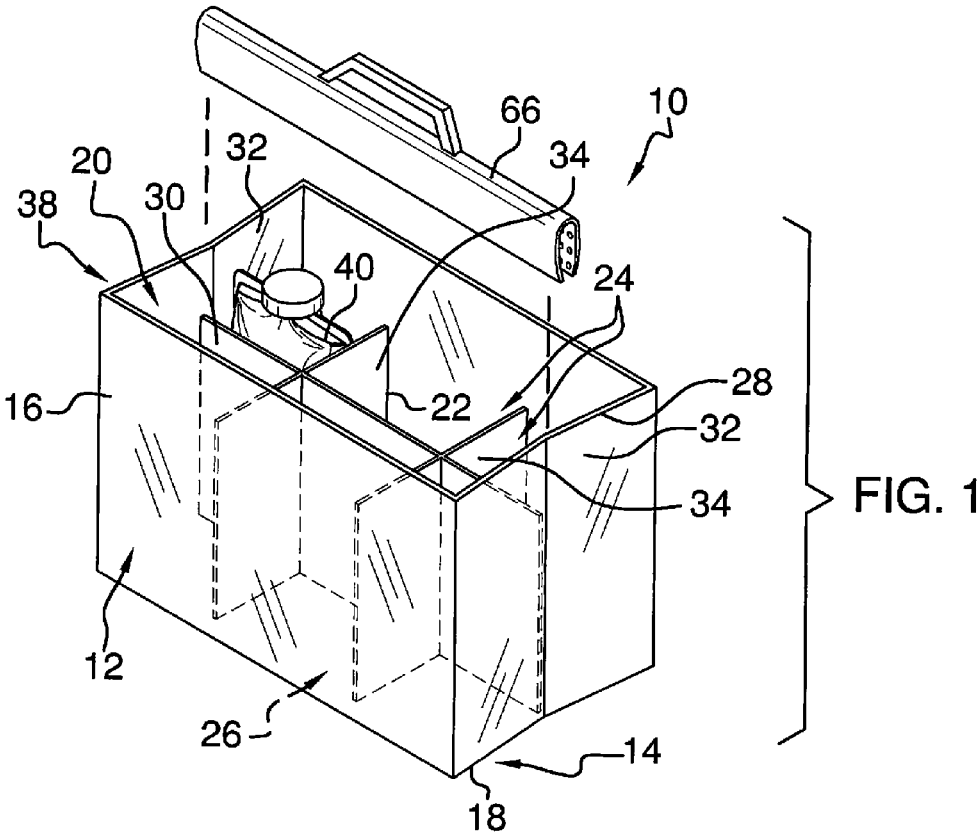
FIG. 1 is a partially exploded top front side perspective view of a collapsible toiletry container assembly according to an embodiment of the disclosure.
Figure 2:
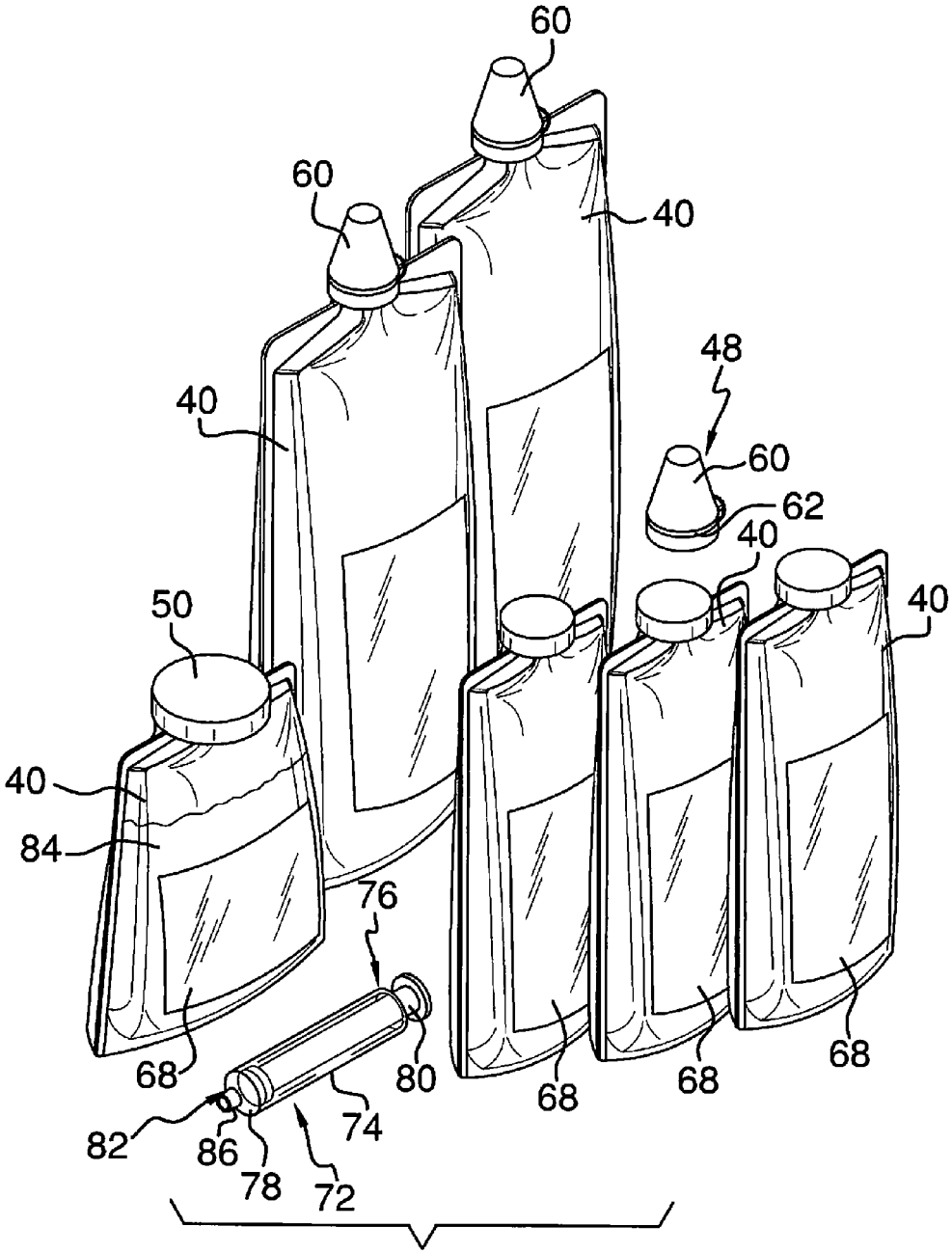
FIG. 2 is a top front side perspective view of an embodiment of the disclosure.
Figure 3:
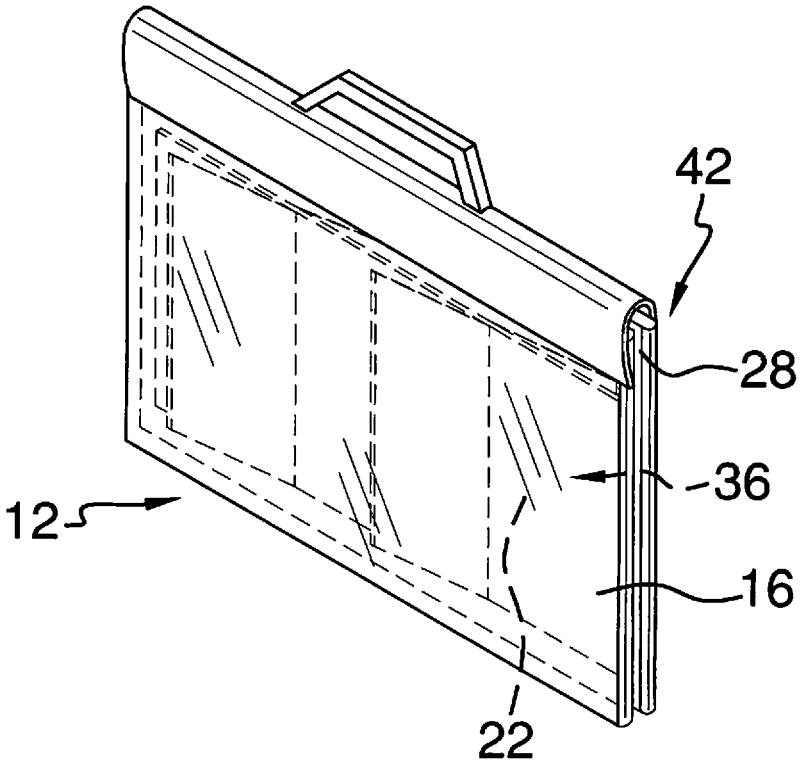
FIG. 3 is a top front side perspective view of an embodiment of the disclosure.
Figure 4:
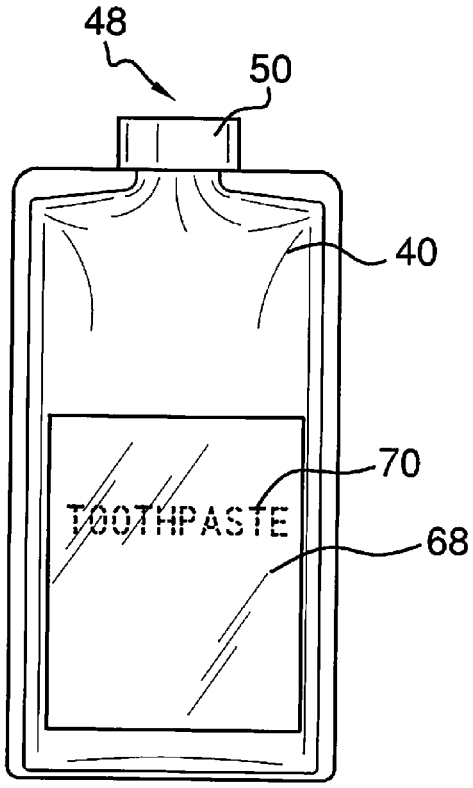
FIG. 4 is a front view of a pouch of an embodiment of the disclosure.
Figure 5:
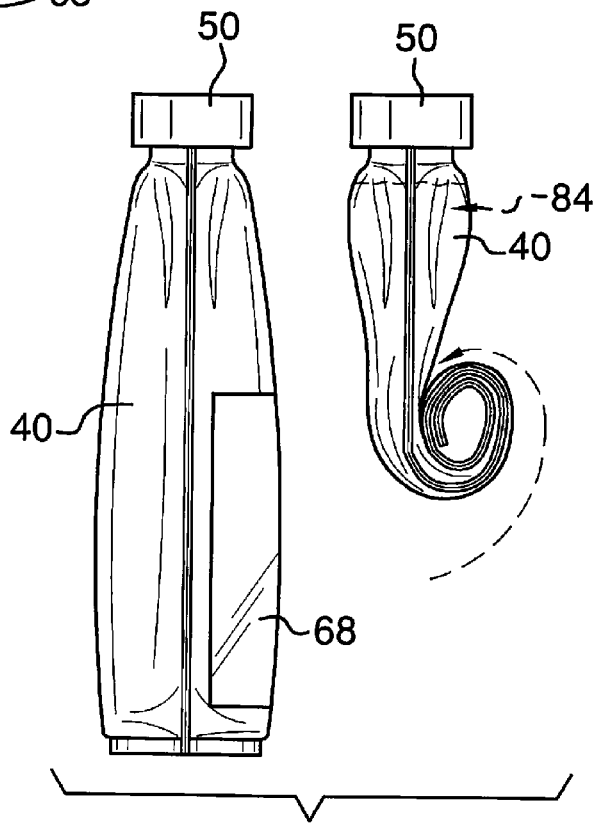
FIG. 5 is a side view of a pouch of an embodiment of the disclosure.
Figure 6:
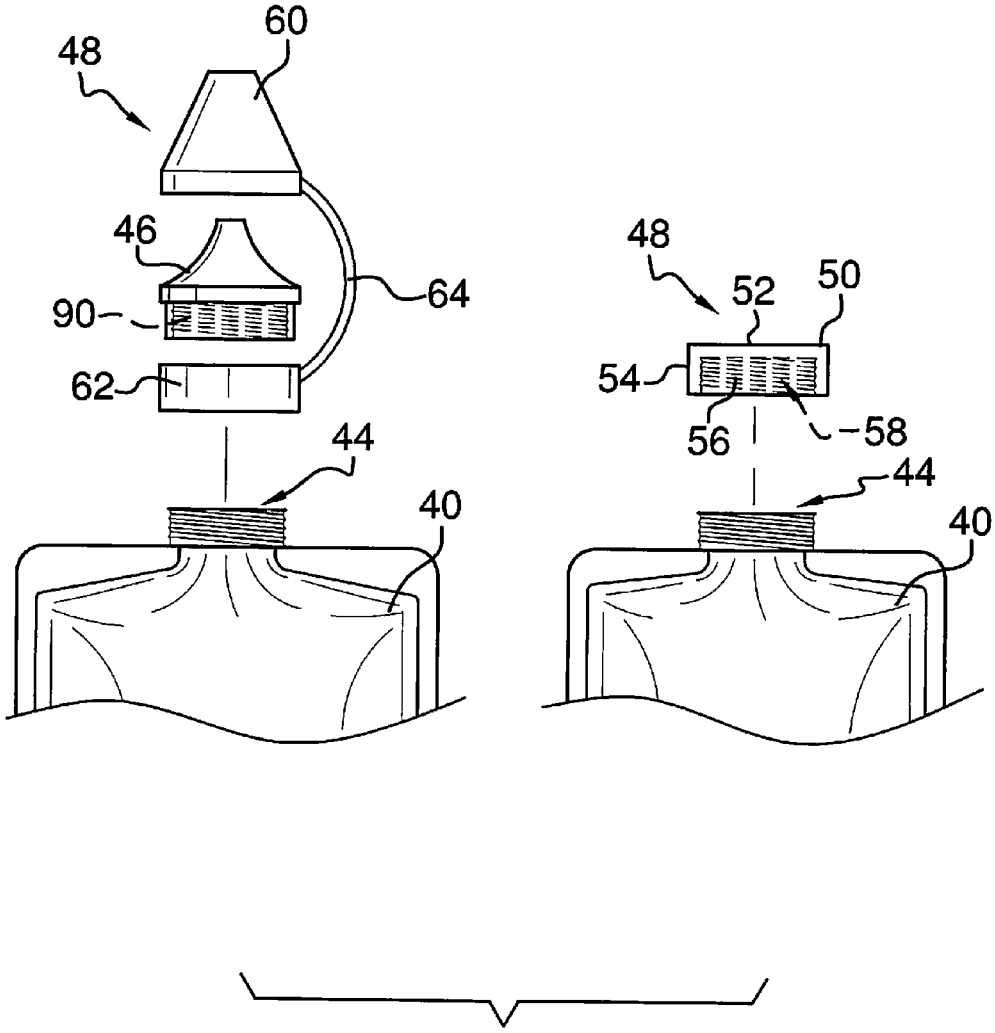
FIG. 6 is a front view of alternative caps of an embodiment of the disclosure.

With reference now to the drawings, and in particular to FIGS. 1 through 6 thereof, a new toiletry transport device embodying the principles and concepts of an embodiment of the disclosure and generally designated by the reference numeral 10 will be described.

As best illustrated in FIGS. 1 through 6, the collapsible toiletry container assembly 10 generally comprises a container 12 having a bottom panel 14 and a flexible perimeter wall 16 extending upwardly from a perimeter edge 18 of the bottom panel 14 defining an interior space 20.

A divider 22 is positioned in the interior space 20. The divider 22 defines a plurality of compartments 24 in a bottom 26 of the interior space 20. A top portion 28 of the perimeter wall 16 extends upwardly from the divider 22. The divider 22 is comprised of a main wall 30. The main wall 30 is coupled to and extends between opposite sections 32 of the perimeter wall 16. The divider 22 includes a plurality of flaps 34 pivotally coupled to and extending from the main wall 30. Each of the flaps 34 pivots between a storage position 36 and a deployed position 38.

A plurality of pouches 40 is positionable in a selectable one of the compartments 24 in the interior space 20. The top portion 28 is foldable into an overlapping closed position 42 over the pouches 40 when the pouches are positioned in the interior space 20, with each pouch 40 having an opening 44. A plurality of pouch nozzles 46 is couplable to a selectable one of the pouches 40 by threading 90. A plurality of caps 48 is couplable to a selectable one of the pouches 40 wherein the opening 44 in the pouch 40 is closed. The caps 48 include a plurality of storage caps 50. Each storage cap 50 has a continuous top panel 52 and a peripheral wall 54 extending from the top panel 52. Threading 56 on an inwardly facing surface 58 of the peripheral wall 54 allows each storage cap 50 to seal the pouch 40 when the storage cap 50 is coupled to the pouch 40. The caps 48 include a plurality of dispensing caps 60. Each dispensing cap 60 engages an associated one of the nozzles 46 wherein the dispensing cap 60 is coupled to and covers the nozzle 46. Each dispensing cap 60 has a collar 62 coupled to the dispensing cap 60 by a tether 64 extending between the dispensing cap 60 and the collar 62. The collar 62 is positionable around the opening 44 in the pouch 40. The nozzle 46 is coupled to the pouch 40 securing the collar 62 to the pouch 40.

A clip 66 is couplable to the top portion 28 of the perimeter wall 16 when the top portion 28 is in the closed position 42 wherein the clip 66 holds the top portion 28 in the closed position 42. Each pouch 40 has a label 68. The label 68 is configured for erasably receiving indicia 70 to indicate contents of the pouch 40. A syringe 72 is comprised of a barrel 74 having a first end 76 and a second end 78. A plunger 80 is slidably inserted into the first end 76 of the barrel 74 and an opening 82 through the second end 78 of the barrel 74. The syringe 72 is configured for selectively receiving and dispensing a fluid 84 by sliding the plunger 80 in the barrel 74. The syringe 72 is comprised of a nozzle 86 which extends from the second end 78 of the barrel 74. The nozzle 86 is aligned with the opening 82 through the second end 78 of the barrel 74.

In use, the syringe 72 is used to fill the pouches 40 with selected toiletry items such as shampoo, lotion, toothpaste, liquid soap, conditioner, or any other similar substance. The pouches 40 may be labeled and are closed using a cap 48, which may be a storage cap 50 or a dispensing cap 60 used with a pouch nozzle 46. The pouches 40 are positioned in the compartments 24 and the container 12 closed and held with the clip 66. The container 12 may be packed into luggage for travel and the necessary toiletry items accessed as needed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A collapsible toiletry container assembly comprising:

a container having a bottom panel and a flexible perimeter wall extending upwardly from a perimeter edge of said bottom panel defining an interior space;

a divider positioned in said interior space, said divider defining a plurality of compartments in a bottom of said interior space, a top portion of said perimeter wall extending upwardly from said divider;

a plurality of pouches, each pouch being positionable in a selectable one of said compartments in said interior space wherein said top portion is foldable into an overlapping closed position over said pouches when said pouches are positioned in said interior space, each pouch having an opening;

a plurality of caps, each cap being couplable to a selectable one of said pouches wherein said opening in each of said pouches is closed by an associated one of said caps; and a clip being couplable to said top portion of said perimeter wall when said top portion is in said closed position wherein said clip holds said top portion in said closed position.

2. The assembly of claim 1, further comprising said divider comprising a main wall, said main wall being coupled to and extending between opposite sections of said perimeter wall.

3. The assembly of claim 2, further comprising said divider comprising a plurality of flaps pivotally coupled to and extending from said main wall, each of said flaps pivoting between a storage position and a deployed position.

4. The assembly of claim 1, further comprising said caps including a plurality of storage caps, each storage cap having a continuous top panel, a peripheral wall extending from said top panel, and threading on an inwardly facing surface of said peripheral wall wherein each said storage cap seals one of said pouches when said storage cap is coupled to one of said pouches.

5. The assembly of claim 1, further comprising:

a plurality of nozzles, each nozzle being couplable to a selectable one of said pouches; and said caps each including a dispensing cap, each said dispensing cap engaging an associated one of said nozzles wherein said dispensing cap is coupled to and covers said associated one of said nozzles.

6. The assembly of claim 5, further comprising each dispensing cap having a collar coupled to said dispensing cap by a tether extending between said dispensing cap and said collar, said collar being positionable around said opening in said associated one of said pouches, said associated one of said nozzles securing said collar to said associated one of said pouches.

7. The assembly of claim 1, further comprising each said pouch having a label thereon, said label being configured for erasably receiving indicia to indicate contents of said pouch.

8. The assembly of claim 1, further comprising a syringe, said syringe comprising a barrel having a first end and a second end, a plunger slidably inserted into said first end of said barrel, and an opening through said second end of said barrel wherein said syringe is configured for selectively receiving and dispensing a fluid by sliding said plunger in said barrel.

9. The assembly of claim 8, further comprising said syringe comprising a syringe nozzle extending from said second end of said barrel, said syringe nozzle being aligned with said opening through said second end of said barrel.

10. A collapsible toiletry container assembly comprising:

a container having a bottom panel and a flexible perimeter wall extending upwardly from a perimeter edge of said bottom panel defining an interior space;

a divider positioned in said interior space, said divider defining a plurality of compartments in a bottom of said interior space, a top portion of said perimeter wall extending upwardly from said divider, said divider comprising a main wall, said main wall being coupled to and extending between opposite sections of said perimeter wall, said divider comprising a plurality of flaps pivotally coupled to and extending from said main wall, each of said flaps pivoting between a storage position and a deployed position;

a plurality of pouches, each pouch being positionable in a selectable one of said compartments in said interior space wherein said top portion is foldable into an overlapping closed position over said pouches when said pouches are positioned in said interior space, each pouch having an opening;

a plurality of pouch nozzles, each pouch nozzle being couplable to a selectable one of said pouches;

a plurality of caps, each cap being couplable to a selectable one of said pouches wherein said opening in each of said pouches is closed by an associated one of said caps, said caps including a plurality of storage caps, each storage cap having a continuous top panel, a peripheral wall extending from said top panel, and threading on an inwardly facing surface of said peripheral wall wherein each said storage cap seals said pouch when said storage cap is coupled to said pouch, said caps including a plurality of dispensing caps, each dispensing cap engaging an associated one of said nozzles wherein said dispensing cap is coupled to and covers said associated one of said nozzles, each dispensing cap having a collar coupled to said dispensing cap by a tether extending between said dispensing cap and said collar, said collar being positionable around said opening in an associated one of said pouches, said associated one of said nozzles securing said collar to an associated one of said pouches;

a clip, said clip being couplable to said top portion of said perimeter wall when said top portion is in said closed position wherein said clip holds said top portion in said closed position;

each said pouch having a label thereon, said label being configured for erasably receiving indicia to indicate contents of said pouch; and a syringe, said syringe comprising a barrel having a first end and a second end, a plunger slidably inserted into said first end of said barrel, and an opening through said second end of said barrel wherein said syringe is configured for selectively receiving and dispensing a fluid by sliding said plunger in said barrel, said syringe comprising a syringe nozzle extending from said second end of said barrel, said syringe nozzle being aligned with said opening through said second end of said barrel.

* * * * *